US005444424A

United States Patent [19]

Wong et al.

[11] Patent Number: 5,444,424

[45] Date of Patent: Aug. 22, 1995

[54] CIRCUIT BREAKER TRIP SOLENOID HAVING OVER-TRAVEL MECHANISM

[75] Inventors: Tak M. Wong, Cedar Rapids; Thomas M. Henson, Marion, both of Iowa

[73] Assignee: Square D Company, Palatine, Ill.

[21] Appl. No.: 143,814

[22] Filed: Oct. 27, 1993

[51] Int. Cl.[6] ..... H01H 9/00

[52] U.S. Cl. ..... 335/172; 335/175

[58] Field of Search ..... 335/167–176, 335/23–25

[56] References Cited

U.S. PATENT DOCUMENTS 5,162,765 11/1992 DiVincenzo et al. ..... 335/175

5,343,179 8/1994 Pipich et al. ..... 335/167

*Primary Examiner*—Lincoln Donovan

*Attorney, Agent, or Firm*—Kareem M. Irfan; Larry I. Golden

[57] ABSTRACT

For a circuit breaker a trip solenoid assembly is provided for initiating separation of a pair of contacts within the circuit breaker. The trip solenoid assembly incorporates a solenoid having a metal sleeve with a plunger that moves reciprocatingly within the metal sleeve. A cap is disposed at one end of the plunger having a tab extending therefrom with a tab aperture therein. The plunger has a slot defined by a pair of prongs for receiving the tab, the pair of prongs each have a plunger aperture therein. A retaining pin located within the cap aperture and the plunger apertures retains the cap on the plunger together. The retaining pin retains the cap to the plunger in such a way as to allow the cap and the plunger to have relational movement with respect to each other. A compression spring is positioned between the solenoid and the retaining pin for biasing the plunger in a direction away from the solenoid so that when the solenoid is energized the plunger will move in a direction away from the solenoid.

25 Claims, 6 Drawing Sheets

CIRCUIT BREAKER TRIP SOLENOID HAVING OVER-TRAVEL MECHANISM

FIELD OF THE INVENTION

This invention relates generally to circuit breaker trip systems and, more Specifically, to trip solenoids communicating with electronic trip unit circuit boards for actuating the circuit breaker mechanism.

BACKGROUND OF THE INVENTION

Thermal magnetic current limiting circuit breakers are well known in the prior art. Examples of such circuit breakers are disclosed in U.S. Pat. Nos. 3,943,316, 3,943,472, 3,943,473, 3,944,953, 3,946,346, 4,612,430, 4,618,751, and 5,223,681 which are assigned to the same assignee as the present application, and which are hereby incorporated by reference. Basically, a current limiting circuit breaker comprises a base and cover, a stationary contact, a movable contact secured to a rotatable blade, arc interrupting chamber, an operating mechanism for opening and closing the contacts, and a trip unit which releases the operating mechanism when a predetermined amount of current is exceeded.

Trip systems are designed to respond to power faults detected in the circuit breaker. The above-mentioned circuit breakers employ a thermal magnetic trip systems to trip the circuit breaker in response to short circuit or overload faults. The thermal magnetic trip systems utilize a magnetic field to trip the circuit breaker. When the current level increases beyond a predetermined threshold, the magnetic field "trips" a mechanism which causes a set of circuit breaker contacts to release, thereby "breaking" the circuit path. The trip system also employs a bi-metal for detecting thermal overload faults. The extent of the bi-metal's deflection represents an accurate thermal history of the circuit breaker. Generally, the heat generated by the current overload will cause the bi-metal to deflect which initiates the tripping mechanism to break the circuit path.

Thermal magnetic trip systems are generally adequate for many simple circuit breaker applications, but there has been an increasing demand for a more intelligent and flexible tripping system. For example, many factories today include 3-phase power equipment which is often replaced or moved on a regular basis. Consequently, the circuit breaker tripping specification, e.g. current thresholds, for that equipment must be adjusted. Thus, processor-based tripping systems have been developed to provide user-programmable flexibility while maintaining the ability to interrupt the current path in response to fault conditions. These electronic systems employ micro-processor based electronic circuit boards such as the one described in U.S. Pat. No. 5,038,246, issuing on Aug. 6, 1991 to Durivage, III, entitled, "Fault Powered, Processor Controlled Circuit Breaker Trip System Having Reliable Tripping Operation" and is incorporated herein by reference.

Trip solenoids are typically employed in electronic trip circuit breakers for initiating the tripping of the circuit breaker. A representative trip solenoid is shown in U.S. Pat. No. 4,731,692, issued on Mar. 15, 1988 to Square D Company, entitled "Circuit Breaker Trip Solenoid Assembly" and includes an electronic circuit board which generates a trip signal that energizes the trip solenoid which, in further, then actuates the tripping mechanism of the circuit breaker. The disclosure in the '692 patent is incorporated herein by reference.

The trip solenoids in the prior art could cause part breakage when the trip solenoid plunger engaged with other circuit breaker components to initiate the tripping mechanism. In particular, trip solenoids employed plungers that did not allow any over-travel, thereby creating the potential for the plunger to damage other circuit breaker components. A need exists for a trip solenoid assembly that adequately performs the circuit breaker tripping action without creating the environment that could potentially damage circuit breaker components.

SUMMARY OF THE INVENTION

It is a general object of the present invention to provide a trip solenoid assembly for a circuit breaker.

It is a more specific object of the present invention to provide a trip solenoid assembly for a trip system that will induce less stress on components that it interacts with.

In accordance with a preferred embodiment of the present invention a trip solenoid assembly is provided for initiating separation of a pair of contacts within a circuit breaker. The trip solenoid incorporates a solenoid having a solenoid coil with a plunger that moves reciprocatingly within the solenoid coil. A plunger cap is disposed at one end of the plunger and a cap tab extending therefrom with a tab aperture therein. The plunger has a slot defined by a pair of prongs for receiving the plunger cap tab, the pair of prongs each have a plunger aperture therein. A retaining pin located within the cap aperture and the plunger apertures retains the plunger cap on the plunger together. The retaining pin retains the plunger cap to the plunger in such a way as to allow the plunger cap and the plunger to have relational movement with respect to each other. A compression spring is positioned between the solenoid and the retaining pin for biasing the plunger in a direction away from the solenoid so that when the solenoid is energized the plunger will move in a direction away from the solenoid.

In accordance with another aspect of the present invention a circuit interrupter is provided having a trip system for sensing current flow through a pair of separable circuit breaker contacts and initiating separation of the separable contacts when the current exceeds a predetermined amount. The trip system has an electronic system for sensing the current and a tripping module. The tripping module has a housing for enclosing the tripping module, actuation means for actuating separation of the pair of separable contacts when the current exceeds a predetermined amount. A frame is attached to the housing and is adapted for receiving a trip cross bar which interacts with the actuation means to actuate the contact separation. A trip assembly is secured within the housing and is electrically coupled to the electronic system, the trip assembly interacts with the trip cross bar to initiate separation of the pair of separable contacts. The trip assembly has a solenoid and a plunger with a plunger cap secured at one end by an attachment means for retaining cap on the plunger while permitting relational movement between the cap and the plunger.

BRIEF DESCRIPTION OF THE DRAWINGS

Other objects and advantages of the invention will be apparent from the following detailed description and the accompanying drawings in which.

DETAILED DESCRIPTION OF THE PREFERRED EMBODIMENTS

For a better understanding of the present invention together with other and further advantages, and capabilities thereof, reference is made to the following disclosure and appended claims in connection with the above-described drawings.

For exemplary purposes, the invention is shown and described with respect to a three-pole circuit breaker, although the various aspects of the invention are equally applicable to circuit breakers of a different number of poles. The three-pole circuit breaker constructed in accordance with the teachings of the present invention is shown in the Figures as including standard components such as an enclosure, an interrupter assembly, an operating mechanism, and connectors. For instance, representative ones of the aforementioned components or subassemblies are described in U.S. Pat. No. 5,223,681, issued on Jun. 6, 1993 to Buehler et at., entitled "Current Limiting Circuit Breaker with Over Molded Magnet and Metal Plates", and a representative electronic trip system is described in the previously noted U.S. Pat. No. 5,038,246; the disclosure in those patents is incorporated herein by reference and specific structural details of such standard components are not discussed hereinafter.

Figure 1:
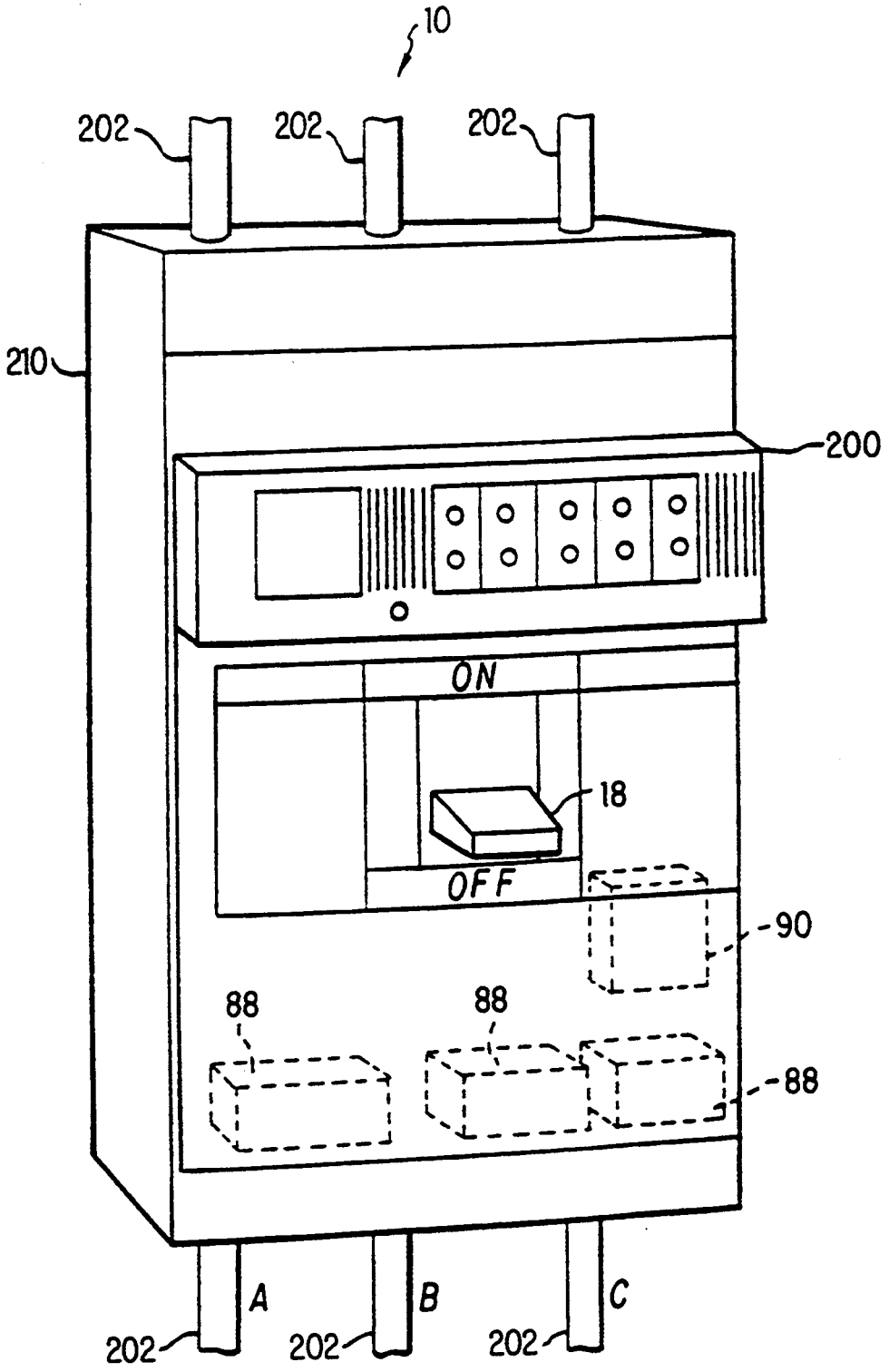
FIG. 1 is a representation perspective view of a circuit breaker which incorporates the subject matter of the present invention.

FIG. 1 is a perspective view of a circuit breaker 10 having a housing or frame 210 and comprising a trip system which includes an electronic system 200 attached to the housing 210 and a tripping module 80 (FIGS. 2–4) enclosed within the housing 210. Current conductors 202 carrying phase currents A, B and C are shown delivering current to a set of current transformer assemblies 88 (symbolized in dashed lines in FIG. 1 and shown in FIGS. 2–4) which are enclosed in the tripping module 80 and are electrically coupled to the electronic system 200. A trip solenoid 90 (symbolized in dashed lines) is utilized to initiate the separation of the current in the current conductors 202. Once the current path is interrupted, the user reconnects the current path using an operating handle 18.

Figure 2:
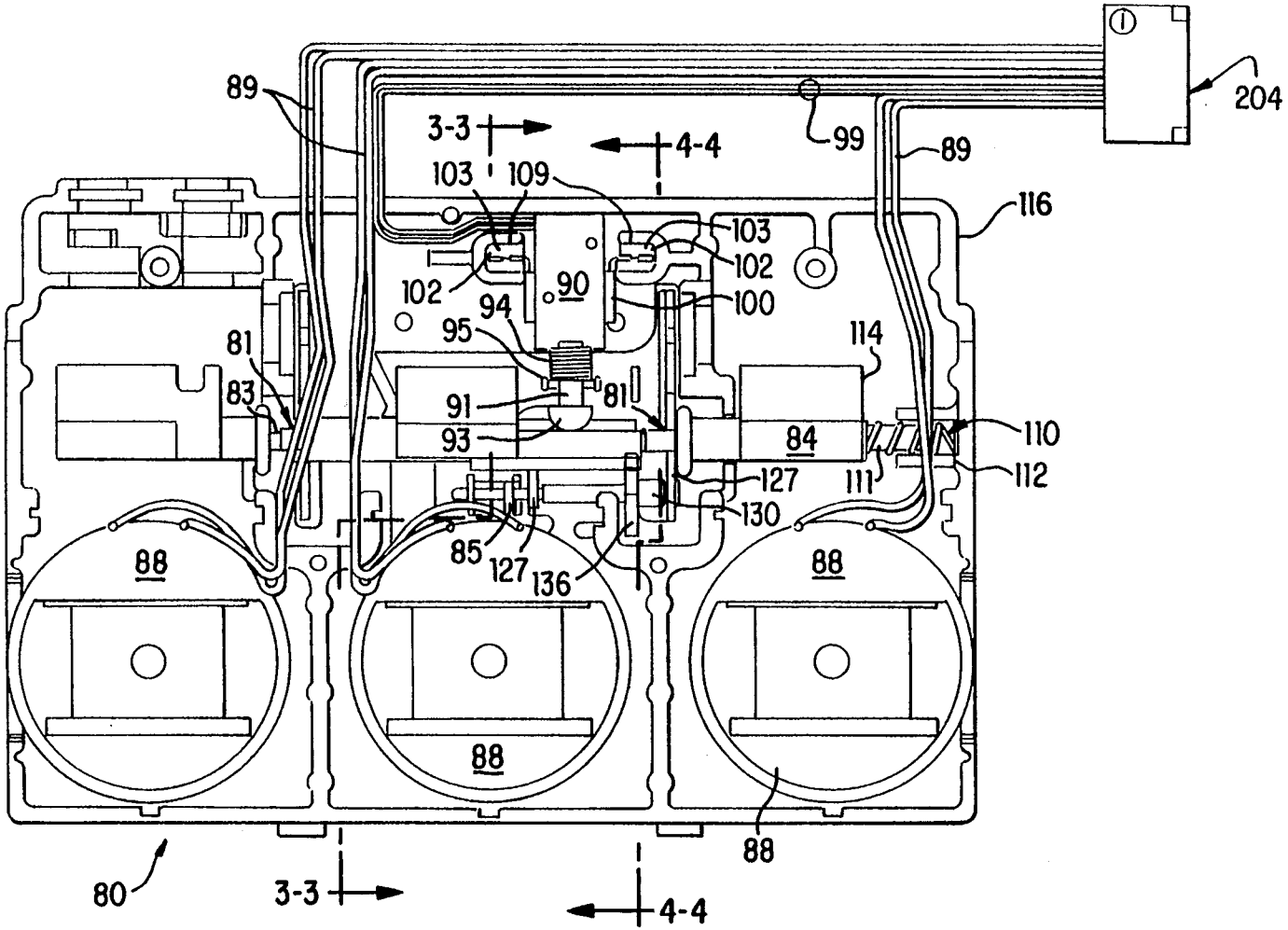
FIG. 2 is a plan view of the tripping module of the circuit breaker of FIG. 1.
Figure 3:
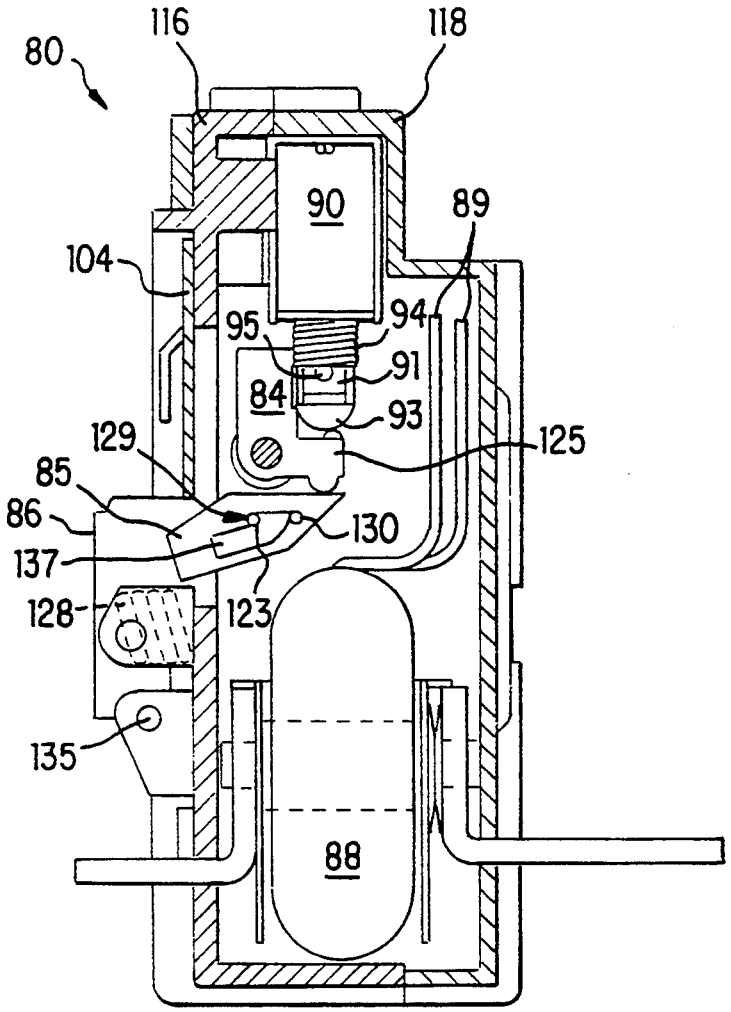
FIG. 3 is cross sectional view of the trip unit used in the circuit breaker of FIG. 1, taken generally along the line 3—3 of FIG. 2.
Figure 4:
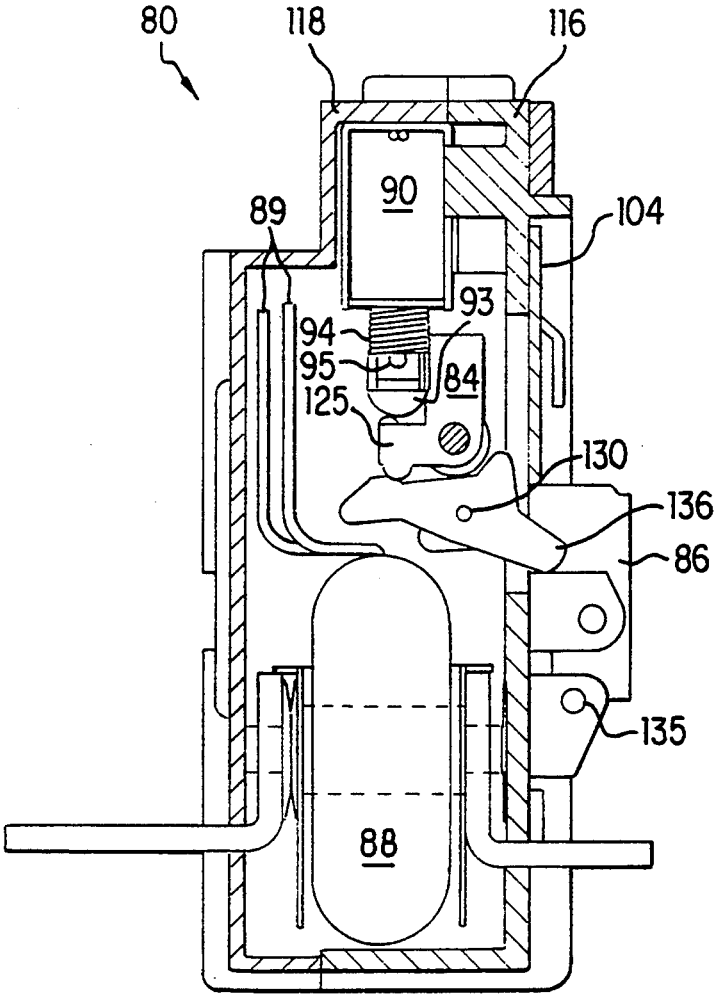
FIG. 4 is a cross sectional view of the trip unit used in the circuit breaker of FIG. 1, taken generally along the line 4—4 of FIG. 2.

As shown in FIGS. 2–4, the tripping module 80 is enclosed in a molded plastic housing 116 having a cover 118 (FIGS. 3 and 4) and including a trip cross bar 84, a trip latch 85, a hammer 86, a trip solenoid assembly 90 and the transformer assemblies 88.

Figure 5:
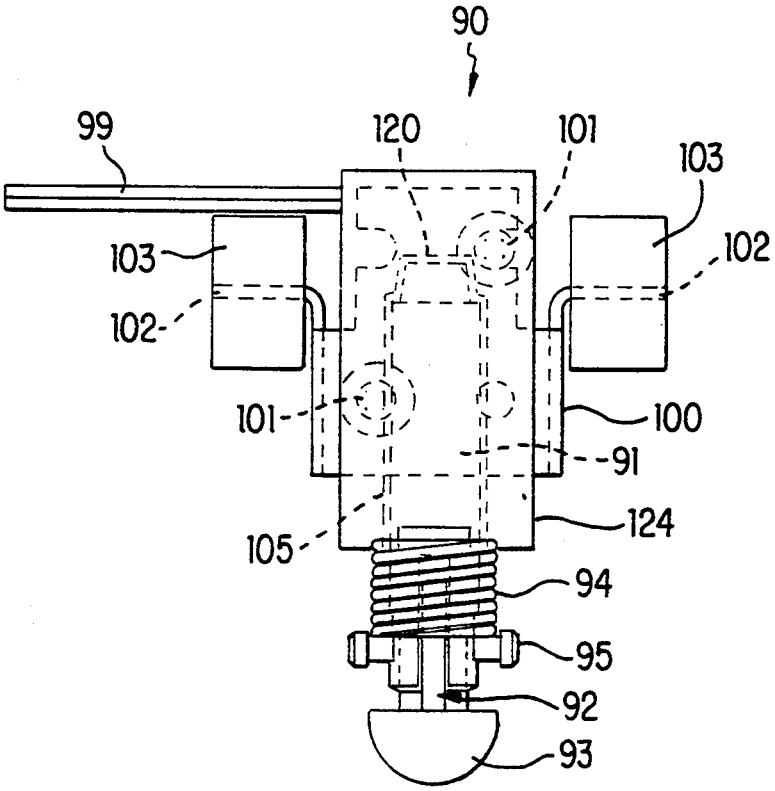
FIG. 5 is a plan front view of the trip solenoid assembly used in the circuit breaker shown in FIG. 1.

Referring to FIG. 5, the trip solenoid assembly 90 includes a typical solenoid 124 having a metal sleeve 105 around which is wound a wire coil (not shown) having two wire solenoid leads 99 extending therefrom. The solenoid assembly 90 has a metal plunger 91 having one end projecting out of an open end of the metal sleeve 105 and the other end adapted to move reciprocatingly within the metal sleeve 105. A permanent magnet (not shown) in the solenoid 124 holds the plunger 91 against a closed end 120 of the metal sleeve 105 at all times, except when the trip solenoid is being energized. Opposing the pull of the permanent magnet is a compression spring 94. The force of the spring on the plunger is less than the attractive force of the permanent magnet so that the plunger is normally positioned pulled into the solenoid assembly.

Figure 7:
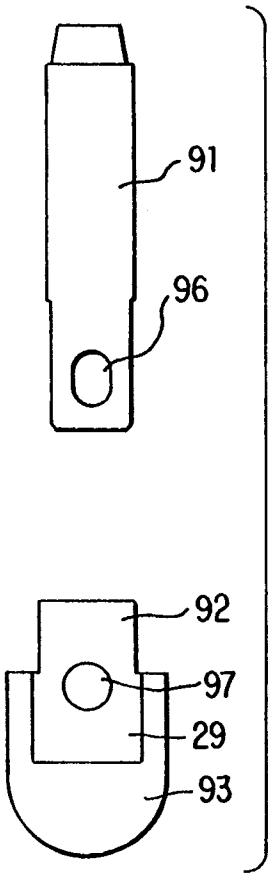
FIG. 7 is a plan side view of a trip solenoid plunger assembly of an the circuit breaker of FIG. 1.
Figure 6:
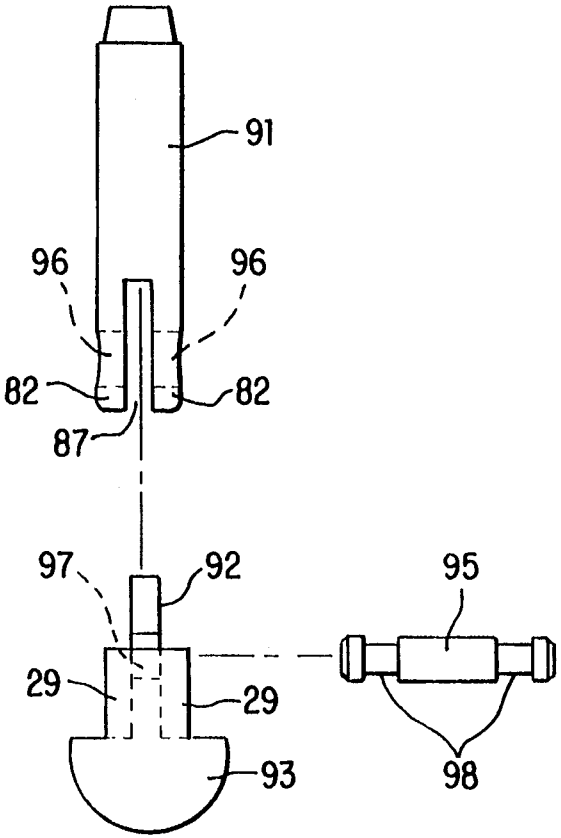
FIG. 6 is a plan side view of a trip solenoid plunger assembly of the circuit breaker of FIG. 1.

As shown in FIGS. 5–7, the end of the plunger 91 that projects out of the metal sleeve 105 includes a pair of prongs 82. The prongs 82 together define a slot 87 (FIGS. 6 and 7) for receiving a plunger cap tab 92 which is formed on a plastic plunger cap 93. The plunger cap 93 is retained onto the plunger 91 with a retaining pin 95 passing through a pair of elongated plunger apertures 96 in the prongs 82 and an aperture 97 in the plunger cap tab 92 of the plunger cap 93. The diameter of the tab aperture 97 and the elongated plunger apertures 96 is slightly larger than the diameter of the retaining pin 95 so that the retaining pin 95 may freely pass through the apertures. The plunger cap 93 has a recess 29 on each side for allowing the prongs 82 to move freely in the plunger cap 93. The retaining pin 95 has a pair of retaining pin grooves 98 whose diameter is slightly smaller than the diameter of the overall diameter of the retaining pin 95 for retaining one end of the compression spring 94 therein thus holding the retaining pin 95 in place. When the solenoid is de-energized the plunger 91 is engaged in the solenoid and the attractive force of the solenoid permanent magnet is greater than the force of the spring 94, therefore, the spring 94 is compressed forcing the retaining pin 95 against one side of the elongated apertures 96. When the solenoid 124 is energized the permanent magnet no longer holds the plunger thereby allowing the compression spring to become decompressed and pushing to the plunger out.

According to one aspect of the present invention, the plunger and plunger cap have a range of movement defined by the size of the elongated plunger apertures 96. In particular, the elongated plunger apertures 96 are sized to allow the cross pin 95 to have some over-travel movement along the length of the plunger 91, thus allowing the plunger cap 93 or the plunger 91 to move freely when the other becomes stationary, thereby preventing the components that engage the plunger cap from becoming overstessed and breaking. For example, when the solenoid 124 is energized the plunger 91 is released from the solenoid and the compression spring 94 pushes the plunger 91 outwardly causing the plunger cap 93 into the trip cross bar 84 (FIGS. 2–4) and forcing it the rotate. When the cross bar 84 comes to the end of its rotational movement the cross bar 84 and plunger cap 93 become stationary, however the plunger 91 may still move without applying any more force to the cross bar 84, thereby eliminating the potential of damaging the cross bar 84.

A simple action occurs when the cross bar 84 is utilized to "reset" the plunger 91 into the solenoid 124. To reset the solenoid plunger 91 into the solenoid 124, a reset arm 136 (FIG. 3) is rotated about a latch pivot pin 130 and engaging the cross bar tab 125 of the crossbar 84. The cross bar tab 125 is forced against the plunger cap 93 forcing the plunger 91 into the solenoid until it is fully engaged in the solenoid. When the plunger 91 becomes fully engaged in the solenoid 124 it becomes stationary, however the reset arm 136 may still be applying a force to the cross bar tab 125 and thereby applying pressure against the plunger cap 93. This situation would normally cause the cross bar tab 125 to be under stress and could eventually damage it. However, with the over-travel arrangement provided by the elongated plunger apertures 96, the plunger cap 93 may continue moving until the retaining pin 95 engages the end of the elongated plunger apertures 96, by which point the reset arm 136 will have ended its force on the cross bar tab 125. This over-travel feature allows the cross bar 84 to continue applying a force on the plunger cap 93 until after the plunger 91 is reset into the solenoid, thereby insuring that the plunger is reset without generating additional stress on the cross bar. Hence the stress on the crossbar is also reduced and the cross bar is prevented from becoming overstressed and damaged.

FIG. 5 also shows pair of screws 101 used to attach the solenoid 124 to a solenoid mounting bracket 100. The mounting bracket 100 has a pair of mounting legs 102 which are covered with silicone tubes 103. The mounting legs 102, covered with the silicone tubes 103, are wedged into a pair of solenoid assembly mounting slots 109 (FIG. 2) formed in the trip unit module housing 116 and held in place by the fight friction fit thereby holding the solenoid assembly 90 in the trip unit module housing 116. In addition to holding the solenoid assembly 90 in the trip unit module housing 116, the silicone tubes 103 provide shock absorption to the solenoid assembly 90 by preventing the vibrations that are generated in the circuit breaker from being transferred to the solenoid assembly 90.

Referring now to FIGS. 2 and 3 the stored energy section of the trip unit, [which is essentially as described in U.S. Pat. No. 5,223,681]is shown having trip unit frame 104, hammer 86, trip latch 85, latch pivot pin 130, and a trip unit main compression spring 128. Trip unit frame 104 is secured to the outside of trip unit module housing 116 having trip unit frame aperture (not shown) therein, and mounting tabs 127 (FIG. 2) extending therefrom and into the trip unit module housing 116. The hammer 86 is pivotally mounted between hammer securing tabs (not shown) by hammer pivot pin 135. The trip unit main compression spring 128, disposed between hammer 86 and trip unit frame 104, forces the hammer 86 in a rotational direction away from the trip unit frame 104, in the TRIPPED position. The trip latch 85 is of a tear-drop shape and has an aperture 137 is secured between the walls (not shown) of hammer 86 by the latch pivot pin 130 passing through the aperture 137 and securing to the hammer walls. Latch pivot pin 130 is a one piece part that has been milled to have different diameters. Trip latch 85 rotates about latch pivot pin 130, while latching surface 129 engages latch pin 123 to hold the hammer 86 in a latched position. The latch pin 123, has each end disposed in apertures in the hammer walls and passes through the aperture 137 in the trip latch 85 and engages the latching surface 129 when the circuit breaker is in the ON (or dosed) position.

When the circuit breaker is in the ON position, the compression spring 128 is compressed between the trip unit frame 104 and the hammer 86 thereby holding the latch pin 123 in engagement with the latching surface 129 due to the force created by the compressed compression spring 128 pulling the latch pin 123 against the latching surface 129. A trip latch torsion spring (not shown) is positioned around the latch pivot pin 130 and has a hook at each end that engages mounting tab 127 at one end and the trip latch 85 at the other end, for biasing the trip latch 85 into a latched position. A reset arm torsion spring (not shown) is placed around the latch pivot-pin 130 and engages the trip unit frame 104 at one end and hooks onto the reset arm 136 (FIG. 4) at the other end, wherein the reset arm 136 rotates about latch pivot pin 130.

As current flows through the transformer assemblies 88 an electrical signal is generated and sent to the electronic system 200 (FIG. 1) via associated pairs of transformer wire leads 89. The current signal transmitted on the transformer wire leads 89 is a representation of the actual current flowing through the circuit breaker. The transformer wire leads 89 and the solenoid leads 99 are coupled to the electronic system 200 through a connector 204. The electronic system 200 receives the current signals from the transformer assemblies 88 and determines if a fault condition exists. When the electronic system 200 detects a fault condition, or otherwise determines that the current path should be interrupted, it energizes the trip solenoid 124 (FIG. 5) via the wire solenoid leads 99, allowing the compression spring 94 to move the plunger 91 to the extended position forcing the cap 93 into the cross bar tab 125, which rotates the trip crossbar tab 125 into the trip latch 85. The trip latch 85 then rotates moving the latching surface 129 away from latch pin 123 releasing the trip unit main compression spring 128. The compression spring 128 expands outwardly from the trip unit frame 104 and forces the hammer 86 to rotate about hammer pivot pin 135, thereby causing the hammer to actuate the operating mechanism (not shown) and causing the circuit breaker to interrupt the current flowing in the current conductors 202 (FIG. 1 ).

While there have been shown and described what are at present considered the preferred embodiments of the invention, it will be obvious to those skilled in the art that various changes and modifications may be made therein without departing from the scope of the invention as defined by the appended claims.

What is claimed is:

1. A trip assembly for a circuit breaker having an electronic trip system, said trip assembly comprising:

a solenoid having a metal sleeve therein;

a plunger that moves reciprocatingly within said metal sleeve and includes an end projecting outwardly therefrom;

a cap disposed at said projecting end of said plunger, said cap including a tab extending therefrom and having a tab aperture therein;

said plunger having a slot defined by a pair of prongs for receiving said tab, said pair of prongs each have a plunger aperture therein;

a retaining pin located within said tab aperture and said plunger apertures for retaining said cap on said plunger while permitting relational movement between said cap and said plunger; and a compression spring, positioned between said solenoid and said retaining pin, for biasing said plunger in a direction away from said solenoid so that when said solenoid is energized said plunger will move in a direction away from said solenoid.

2. A trip assembly according to claim 1, wherein said plunger apertures are elongated, thereby allowing said retaining pin to have a range of movement defined by the length of said elongated plunger apertures.

3. A trip assembly according to claim 1 further including a bracket attached to said solenoid, said bracket having a pair of bracket mounting legs for securing said trip assembly within the circuit breaker.

4. A trip assembly according to claim 3 further including a silicone tube surrounding each one of said pair of bracket mounting legs.

5. A trip assembly according to claim 1, wherein said cap further having a recess therein on each side thereof for allowing said prongs to move freely in the cap.

6. A circuit breaker according to claim 1, wherein said retaining pin has a pair of grooves for retaining one end of said compression spring, thereby holding said retaining pin in place.

7. A circuit interrupter having a trip system for sensing current flow through a pair of separable contacts and initiating separation of the pair of separable contacts when the current exceeds a predetermined amount, said trip system comprising:

an electronic module for sensing current; and a tripping module comprising:

a housing for enclosing said tripping module;

actuation means for actuating separation of the pair of separable contacts when the current exceeds a predetermined amount;

a frame, attached to said housing, adapted for receiving a trip cross bar which interacts with said actuation means; and a trip assembly, secured within said housing and electrically coupled to said electronic module, which interacts with said trip cross bar to initiate the separation of the pair of separable contacts, said trip assembly having a solenoid and a plunger with a cap secured at one end by attachment means for retaining said cap on said plunger while permitting relational movement between said cap and said plunger.

8. A circuit interrupter according to claim 7, wherein said attachment means comprising:

a tab formed on said cap having a cap aperture therein;

said plunger having a slot defined by a pair of prongs for receiving said tab, said pair of prongs each have an elongated plunger aperture therein, whereby the elongation of said elongated plunger apertures is in a direction parallel to the length of said plunger;

a retaining pin located within said cap aperture and said elongated plunger apertures for retaining said cap on said plunger, said retaining pin will have a range of movement within said elongated plunger apertures defined by the length of said elongated plunger apertures, thereby allowing said cap to move in relationship to said plunger;

a compression spring, positioned between said solenoid and said retaining pin, for securing said retaining pin within said cap aperture and said elongated plunger apertures and for biasing said plunger in a direction away from said solenoid so that when said solenoid is energized said plunger will move in a direction away from said solenoid.

9. A circuit interrupter according to claim 8, wherein said retaining pin has a pair of grooves for retaining one end of said compression spring, thereby holding said retaining pin in place.

10. A circuit interrupter according claim 7, wherein said tripping module further includes a set of transformer assemblies which are electrically coupled to said electronic system.

11. A circuit interrupter according to claim 7 further including a bracket attached to said solenoid, said bracket having at least one bracket mounting leg for securing said solenoid within said housing.

12. A circuit interrupter according to claim 11, wherein said housing further including at least one trip assembly mounting slot for retaining said trip assembly within said housing.

13. A circuit interrupter according to claim 12 further including a silicone tube surrounding said bracket mounting leg, whereby said bracket mounting leg is disposed within said trip assembly mounting slot and secured in place by said silicone tube.

14. A circuit interrupter according to claim 8, wherein said cap further having a recess therein on each side thereof for allowing said prongs to move freely in the cap.

15. A circuit interrupter according to claim 7, wherein said actuation means includes a trip unit hammer pivotally secured to said trip unit frame.

16. A circuit interrupter according to claim 15 wherein said actuation means further comprising:

a compression spring positioned between said frame and said trip unit hammer, said compression spring biases said trip unit hammer towards said main latch; and a trip latch pivotally secured to said trip unit frame for holding said trip unit hammer in a position away from said main latch, said trip latch directly interacts with said trip cross bar whereby when said current exceeds a predetermined amount said solenoid is released thereby forcing said plunger into said trip unit cross bar which rotates into said trip latch which will rotate from a trip unit hammer holding position into a release position thereby releasing said trip unit hammer and allowing said trip unit hammer to actuate the separation of the pair of separable contacts.

17. A circuit breaker having a stationary contact, a movable contact, a blade having said movable contact attached at one end, said blade being movable between an open position and a closed position, wherein said movable contact engages said stationary contact when said blade is in the closed position, an operating mechanism for moving said blade between the open position and the dosed position, thereby opening and closing said contacts, a main latch for holding the operating mechanism in the dosed position, and a trip system for sensing current flowing through the contacts and initiating separation of the contacts when the current exceeds a predetermined amount, said trip system comprising:

an electronic module for sensing said current; and a tripping module having a trip solenoid electrically coupled to said electronic module, said trip solenoid having a plunger with a cap secured at one end by attachment means for retaining said cap on said plunger while permitting relational movement between said cap and said plunger.

18. A circuit breaker according to claim 17, wherein said attachment means comprising:

a tab formed on said cap having a cap aperture therein;

said plunger having a slot defined by a pair of prongs for receiving said tab, said pair of prongs each have an elongated plunger aperture therein, whereby the elongation of said elongated plunger apertures is in a direction parallel to the length of said plunger;

a retaining pin located within said cap aperture and said elongated plunger apertures for retaining said cap on said plunger, said retaining pin will have a range of movement within said elongated plunger apertures defined by the length of said elongated plunger apertures, thereby allowing said cap to move in relationship to said plunger;

a compression spring, positioned between said trip solenoid and said retaining pin, for securing said retaining pin within said cap aperture and said elongated plunger apertures and for biasing said plunger in a direction away from said trip solenoid so that when said trip solenoid is energized said plunger will move in a direction away from said trip solenoid.

19. A circuit breaker according to claim 18, wherein said retaining pin has a pair of grooves for retaining one end of said compression spring, thereby holding said retaining pin in place.

20. A circuit breaker according claim 17, wherein said tripping module further includes a set of transformer assemblies which are electrically coupled to said electronic system.

21. A circuit breaker according to claim 17 further including a bracket attached to said trip solenoid, said bracket having at least one bracket mounting leg for securing said trip solenoid within the circuit breaker.

22. A circuit breaker according to claim 21, wherein said tripping module is enclosed in a housing, said housing including at least one mounting slot formed therein for retaining said trip solenoid within said housing.

23. A circuit breaker according to claim 22 further including a silicone tube surrounding said bracket mounting leg, whereby said bracket mounting leg is disposed within said mounting slot and secured in place by said silicone tube.

24. A circuit breaker according to claim 18, wherein said cap further having a recess therein on each side thereof for allowing said prongs to move freely in the cap.

25. A circuit breaker according to claim 17, further comprising:

a housing for enclosing said tripping module;

a trip unit hammer pivotally secured to a trip unit frame which is attached to said housing;

a compression spring positioned between said frame and said trip unit hammer, said compression spring biases said trip unit hammer towards the main latch;

a trip latch pivotally secured to said trip unit frame for holding said trip unit hammer in a position away from the main latch, said trip latch directly interacts with said trip cross bar whereby when said current exceeds a predetermined amount said solenoid is released thereby forcing said plunger into said trip unit cross bar which rotates into said trip latch which will rotate from a trip unit hammer holding position into a release position thereby releasing said trip unit hammer and allowing said trip unit hammer to actuate the main latch and thereby allowing the operating mechanism to separate said pair of separable contacts.

* * * * *